US008303356B2

(12) United States Patent
Nishide

(10) Patent No.: US 8,303,356 B2
(45) Date of Patent: Nov. 6, 2012

(54) TERMINAL FITTING AND ELECTRIC WIRE PROVIDED WITH TERMINAL FITTING

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/061,205

(22) PCT Filed: Jun. 25, 2009

(86) PCT No.: PCT/JP2009/061627

§ 371 (c)(1),
(2), (4) Date: Feb. 28, 2011

(87) PCT Pub. No.: WO2010/029803

PCT Pub. Date: Mar. 18, 2010

(65) Prior Publication Data

US 2011/0151729 A1 Jun. 23, 2011

(30) Foreign Application Priority Data

Sep. 9, 2008 (JP) ..... 2008-231111
Sep. 11, 2008 (JP) ..... 2008-233553

(51) Int. Cl.
*H01R 4/18* (2006.01)

(52) U.S. Cl. ..... 439/877

(58) Field of Classification Search ..... 439/877–882
See application file for complete search history.

(56) References Cited

U.S. PATENT DOCUMENTS 5,486,653 A * 1/1996 Dohi ..... 174/84 C
5,975,965 A * 11/1999 Jordan ..... 439/877
2011/0021092 A1* 1/2011 Ukai ..... 439/877

FOREIGN PATENT DOCUMENTS

JP 2002-190347 7/2002
JP 2004-303526 10/2004
JP 2005-302560 10/2005
JP 2006-228759 8/2006

* cited by examiner

*Primary Examiner* — Gary F. Paumen
(74) *Attorney, Agent, or Firm* — Gerald E. Hespos; Michael J. Porco

(57) ABSTRACT

A terminal fitting includes a terminal connection part and a crimping part. Paired front-side crimping pieces and a lower plate part constitute a wire barrel portion which contacts core wires exposed outside as a result of removal of coating disposed at an end portion of an electric wire and is crimped so as to surround the core wires. Paired rear-side crimping pieces and the lower plate part constitute an insulation barrel portion which contacts coating at the end portion of the electric wire and is crimped so as to surround the coating. At least one pair of the crimping pieces has a thin portion formed thinner than the lower plate part and contacting the electric wire end when the crimping pieces are crimped. The thin portion is formed at an intermediate portion of each crimping piece except for a peripheral portion.

12 Claims, 11 Drawing Sheets

TERMINAL FITTING AND ELECTRIC WIRE PROVIDED WITH TERMINAL FITTING

BACKGROUND OF THE INVENTION

1. Field of the Invention

The present invention relates to a terminal fitting and an electric wire provided with the terminal fitting.

2. Description of the Related Art

A prior-art terminal fitting is disclosed in Japanese Patent Application Laid-Open No. 2006-228759. The terminal connection part to be connected to a mating terminal fitting is formed at the front part of the terminal fitting. The terminal fitting has the lower plate part continuous with the terminal connection part at the rear part thereof. The lower plate part is provided with a pair of front crimping pieces and a pair of rear crimping pieces raised from the left and right side edges thereof. The crimping part is constructed of the crimping pieces and the lower plate part. In detail, the crimping part is constructed of the wire barrel portion where a pair of the front crimping pieces is crimped with the lower plate part and a pair of the front crimping pieces surrounding core wires exposed outside as a result of the removal of the coating disposed at the end portion of the electric wire, and the insulation barrel portion where a pair of the rear crimping pieces is crimped with the lower plate part and a pair of the rear crimping pieces surrounding the end portion of the coated electric wire. Because the terminal fitting is formed by bending a metal plate material having a constant thickness, the thickness of each crimping piece is almost constant.

But in the prior-art terminal fitting, the vertical dimension of the crimping part is the addition of the vertical dimension of the end portion of the electric wire, the thickness of the lower plate part, and the thickness of the crimping piece. When the end portion of the electric wire is thick, the vertical dimension of the crimping part is large. Thus it is difficult to make the height of the crimping part small.

In the above-described prior-art terminal fitting, the dimension of the insulation barrel portion in the left-to-right direction thereof is the addition of the dimension of the end portion of the coated electric wire in the left-to-right direction thereof, the thickness of the left crimping piece, and that of the right crimping piece. The dimension of the insulation barrel portion in the left-to-right direction thereof is the rate-determining factor of the dimension of the terminal fitting in the left-to-right direction thereof. When the end portion of the electric wire is thick, the dimension of the insulation barrel portion in the left-to-right direction thereof is large. Thus it is difficult to make the terminal fitting compact.

The present invention has been completed based on the above-described situation. It is an object of the present invention to make the external dimension of a crimping part small.

SUMMARY OF THE INVENTION

As means for achieving the above-described object, a terminal fitting has comprises a terminal connection part formed at a front part thereof and connected to a mating terminal; and a crimping part formed at a rear part of the terminal fitting and composed of a lower plate part continuous with the terminal connection part and front and rear pairs of crimping pieces disposed respectively at front and rear positions of said crimping part, the crimping pieces in each of the pairs of crimping pieces being raised respectively from left and right side edges of the lower plate part, wherein the pair of front crimping pieces and the lower plate part constitute a wire barrel portion that contacts core wires exposed outside as a result of removal of coating disposed at an end portion of an electric wire and is crimped so as to surround the core wires; the pair of rear crimping pieces and the lower plate part constitute an insulation barrel portion that contacts coating at the end portion of the electric wire and is crimped so as to surround the coating; and at least one pair of the crimping pieces has a thin portion formed thinner than the lower plate part and contacting the end portion of the electric wire when the crimping pieces are crimped; and the thin portion is formed at an intermediate portion of each of the crimping pieces except for a peripheral portion thereof.

The thin portion may be formed in the crimping pieces of the wire barrel portion and contacts the core wires from above when the crimping pieces are crimped.

The thin portion may be formed by recessing an inner surface, of each of the crimping pieces, which is opposed to the end portion of the electric wire when the crimping pieces are crimped.

The thin portion may be formed by recessing an outer surface, of each of the crimping pieces, which faces upward when the crimping pieces are crimped.

The thin portion may be formed on only the crimping pieces of the wire barrel portion.

The thin portion may be formed on the crimping pieces of the insulation barrel portion.

The thin portion may contact the end portion of the electric wire in a lateral direction when the crimping pieces are crimped.

The thin portion may be formed by recessing an inner surface, of each of the front-side and rear side crimping pieces, which is opposed to the end portion of the coated electric wire when the crimping pieces are crimped.

The thin portion may be formed by recessing an outer surface, of each of the crimping pieces, which faces outward in a lateral direction when the crimping pieces are crimped.

The thin portion may be formed on only the crimping pieces of the insulation barrel portion.

The thin portion may be formed at an intermediate portion of each of the crimping pieces by striking.

The invention also relates to an electric wire provided with a terminal fitting connected to an end portion thereof.

The thin portion is formed by recessing the outer surface of the crimping piece or the inner surface thereof. By crimping the crimping part in such a way that the thin portion contacts the end portion of the electric wire with the end portion of the electric wire being surrounded with the crimping part, the terminal fitting is crimped to the end portion of the electric wire. Therefore a portion of the crimping piece corresponding to the thin portion is thin. Accordingly it is possible to decrease the outer dimension of the crimping part. Thereby for example, it is possible to make the height of the crimping part low and the terminal fitting compact.

DETAILED DESCRIPTION OF THE PREFERRED EMBODIMENTS

Embodiment 1

Figure 1:
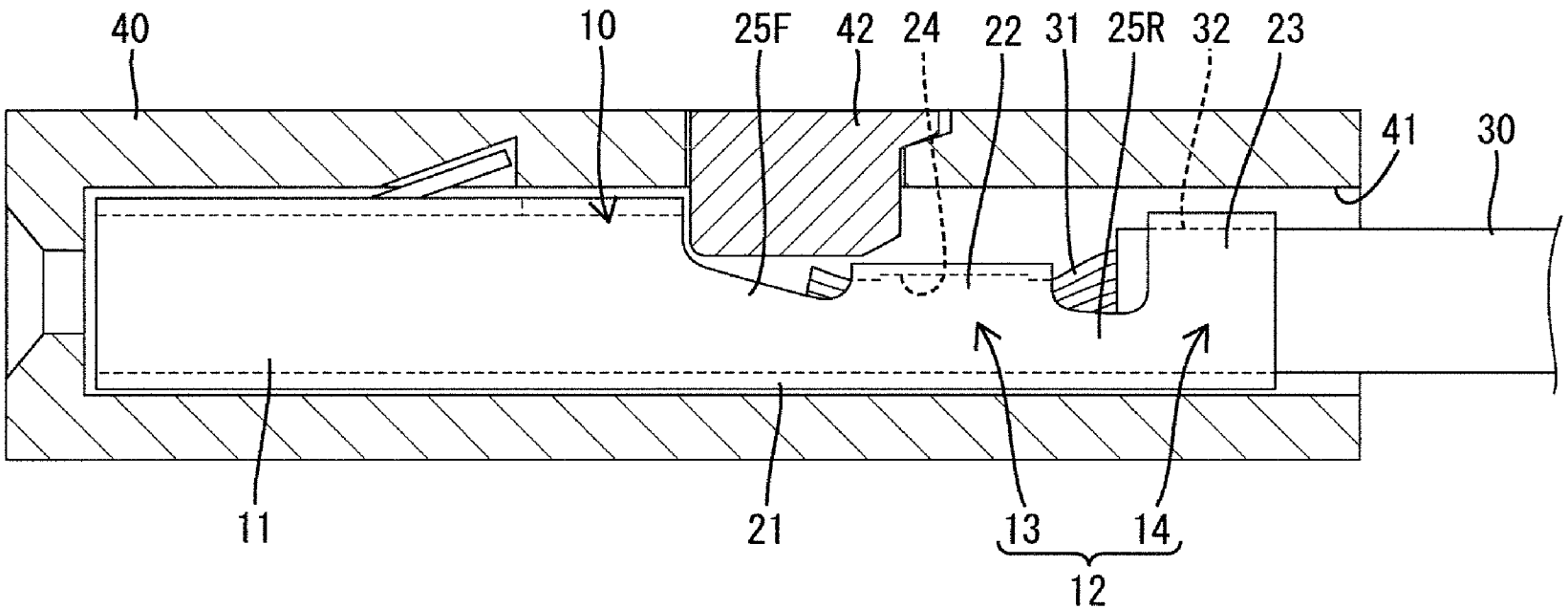
FIG. 1 is a side view showing a state in which an electric wire provided with a terminal fitting of an embodiment 1 is mounted on a connector housing.

The embodiment 1 of the present invention is described below with reference to FIGS. 1 through 4. An electric wire provided with a terminal fitting of the embodiment 1 has an electric wire 30 and a terminal fitting 10 to be crimped to an end portion of the electric wire 30. The terminal fitting 10 is of a female type. At a front part of the terminal fitting 10, there is formed a prism-shaped terminal connection part 11 into which a long and narrow male tab formed on a mating terminal fitting of a male type is inserted to connect the male tab thereto. The electric wire 30 is composed of coating and core wires 31 surrounded with the coating. As the material of the core wire 31, aluminum or an aluminum alloy is used. Because aluminum has a lower conductivity than copper, the diameter of the core wire 31 is set larger than that of a core wire made of copper to secure a predetermined current value.

A crimping part 12 to be crimped to the electric wire 30 is formed at a rear part of the terminal fitting 10. The crimping part 12 is constructed of a wire barrel portion 13 and an insulation barrel portion 14 disposed rearward from the wire barrel portion 13. The wire barrel portion 13 is constructed of a lower plate part 21 continuous with the terminal connection part 11 and a pair of crimping pieces 22 raised at left and right side edges of the lower plate part 21. The lower plate part 21 and the crimping piece 22 are formed symmetrically in the left-to-right direction of the terminal fitting 10. The insulation barrel portion 14 is constructed of apart of the lower plate part 21 rearward from the wire barrel portion 13 and a pair of crimping pieces 23 raised at the left and right side edges of the lower plate part 21. The lower plate part 21 and the crimping piece 23 are also formed symmetrically in the left-to-right direction of the terminal fitting 10. A lower portion of a front end of the crimping piece 22 of the wire barrel portion 13 is continuous with a rear end of a side wall of the terminal connection part 11 through a first connection portion 25F. A lower portion of a rear end of the crimping piece 22 of the wire barrel portion 13 is continuous with a lower portion of a front end of the crimping piece 23 of the insulation barrel portion 14 through a second connection portion 25R.

Figure 2:
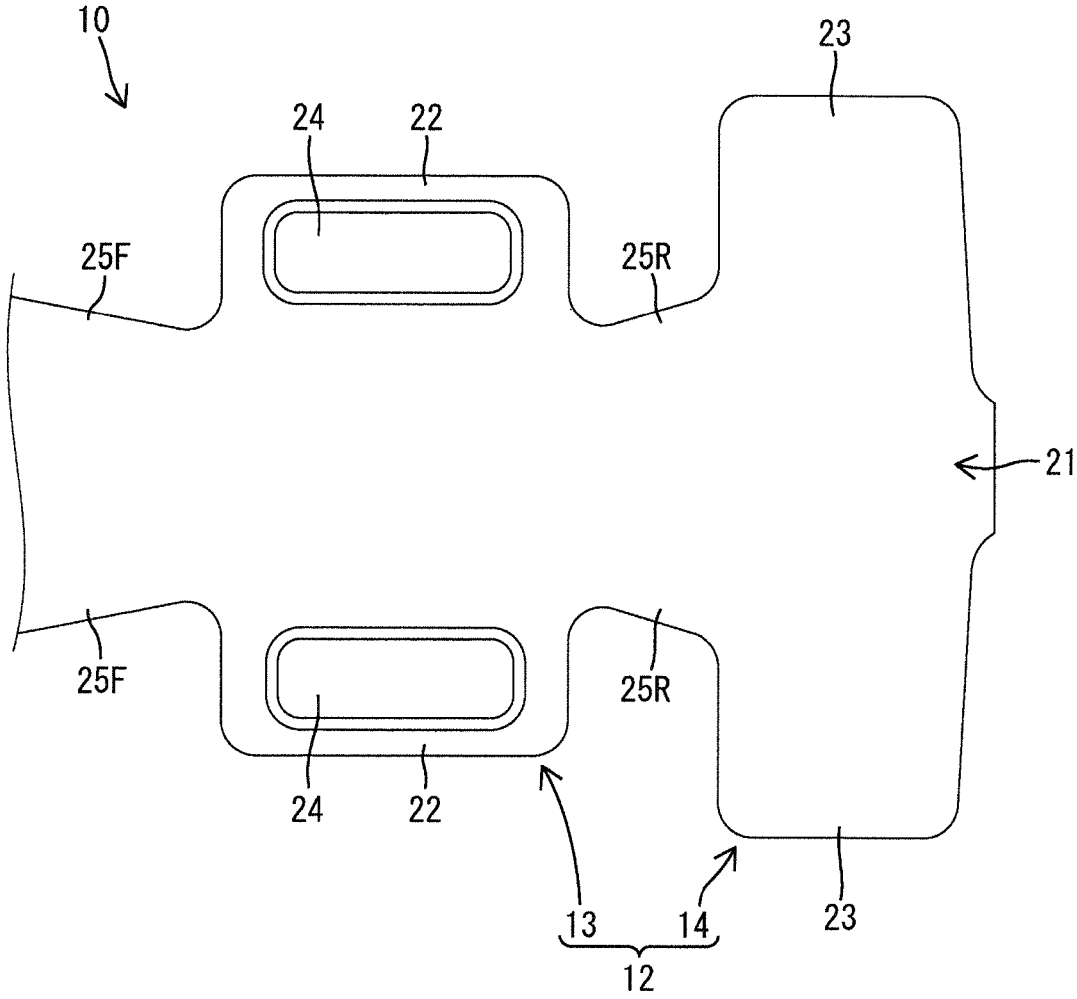
FIG. 2 is a plan view showing the configuration of a crimping part formed by processing a metal plate material of the embodiment 1.
Figure 3:
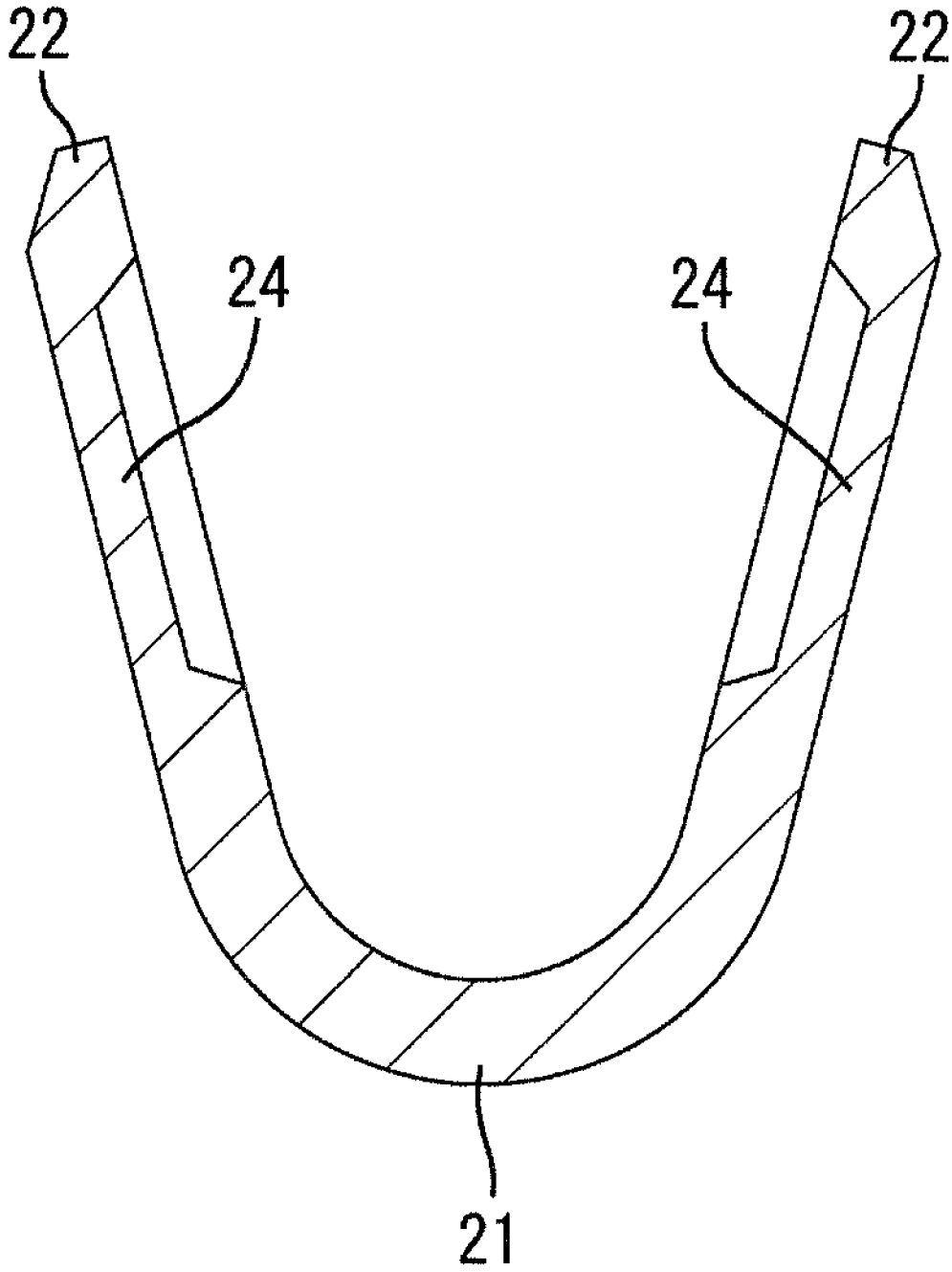
FIG. 3 is a sectional view showing the configuration of a wire barrel portion of the embodiment 1 before the wire barrel portion is crimped to the electric wire.

The entire lower plate part 21 of the wire barrel portion 13 is formed in an almost constant thickness. Each of the crimping pieces 22 of the wire barrel portion 13 is formed thinner than the lower plate part 21 and has a thin portion 24 which contacts the core wires 31 exposed to the outside owing to the removal of the coating disposed at the end portion of the electric wire 30 from above when the crimping piece 22 is crimped. The thin portion 24 is formed by recessing a portion of an inner surface of the crimping piece 22 opposed to the core wires 31 when the crimping piece 22 is crimped. As shown in FIG. 2, the thin portion 24 is formed by punching a metal plate material having a constant thickness into a predetermined configuration and striking a portion of each crimping piece 22 inward from a front edge thereof so as to form the thin portion 24 as a longitudinally long rectangle along the front edge of the crimping piece 22. That is, the thin portion 24 is constructed as a concave portion for each crimping piece 22 by disposing the thin portion 24 at an intermediate portion of the crimping piece 22 except for a peripheral portion thereof. In this case, the thin portion 24 is formed at only the crimping piece 22 of the wire barrel portion 13. For example, the thin portion 24 is not formed at the lower plate part 21. Thus it is possible to restrain the whole length of the terminal fitting 10 from greatly elongating, although the metal plate material is stricken. There is a fear that a portion of the metal plate material corresponding to the thin portion 24 elongates to some extent owing to the striking. But in the embodiment 1, the intermediate portion of each crimping piece 23 is stricken. Therefore only the crimping piece 23 longitudinally elongates to a slight extent.

Figure 4:
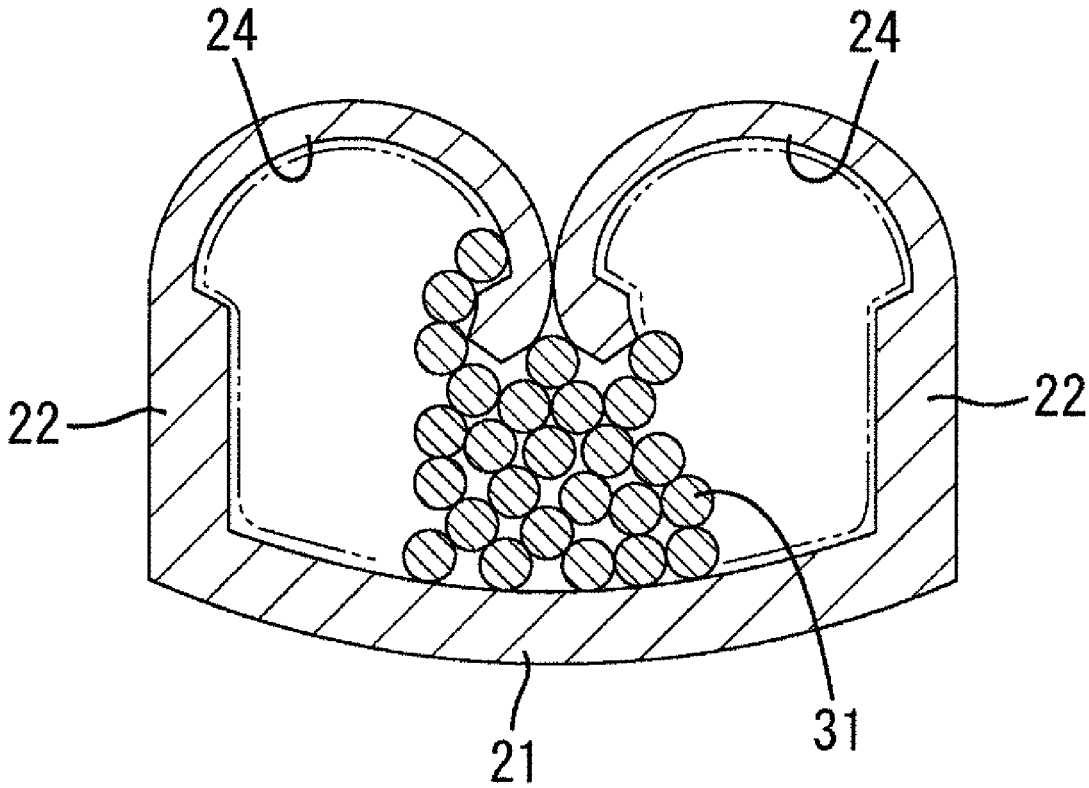
FIG. 4 is a sectional view showing the configuration of the wire barrel portion of the embodiment 1 after the wire barrel portion is crimped to the electric wire.

The electric wire 30 is placed at the lower plate part 21 of the terminal fitting 10 having the above-described construction in such a way that the core wires 31 are positioned at the wire barrel portion 13 and that a portion 32 having the coating disposed at the end portion of the electric wire 30 is positioned at the insulation barrel portion 14. In this state, the crimping piece 22 of the wire barrel portion 13 and the crimping piece 23 of the insulation barrel portion 14 are pressed from above. As shown in FIG. 4, at the wire barrel portion 13, the crimping piece 22 is crimped in such a way that the thin portion 24 contacts the core wires 31 from above with the lower plate part 21 and the crimping piece 22 surrounding the core wires 31 to crimp the terminal fitting 10 to the core wires 31. Therefore it is possible to decrease the vertical dimension of the wire barrel portion 13 and thereby make the height of the wire barrel portion 13 low. At the insulation barrel portion 14, the crimping piece 23 is crimped with the portion 32 having the coating disposed at the end portion of the electric wire 30 being surrounded with the lower plate part 21 and the crimping piece 23 to crimp the terminal fitting 10 to the portion 32 having the coating disposed at the end portion of the electric wire 30. In the state in which the crimping part 12 has been crimped to the electric wire 30, the height of the wire barrel portion 13 is lower than the terminal connection part 11. Thus by utilizing the difference between the height of the wire barrel portion 13 and that of the terminal connection part 11, a space for locking the terminal connection part 11 to a retainer 42 from the rear of the terminal connection part 11 is secured above the wire barrel portion 13.

As shown in FIG. 1, the electric wire provided with the terminal fitting constructed as described above is inserted into a cavity 41 formed inside a connector housing 40. To securely prevent the electric wire provided with the terminal fitting from being removed from the cavity 41, the retainer 42 is fitted in the connector housing 40. The retainer 42 advances to the space disposed above the wire barrel portion 13 and locks a rear end of the terminal connection part 11 thereto. Owing to this locking operation, the terminal fitting 10 is prevented from being removed from the cavity 41. At this time, because the vertical dimension of the wire barrel portion 13 is small, the retainer 42 can be deeply inserted into the cavity 41. Therefore it is possible to take a large locking area between a front-end surface of the retainer 42 and a rear-end surface of the terminal connection part 11 and securely prevent the removal of the electric wire provided with the terminal fitting from the cavity 41.

Because it is possible to make the vertical dimension of the wire barrel portion 13 small, in mounting the terminal fitting 10 on an electric wire having the thick core wire 31, the front-end surface of the retainer 42 can be locked to the rear-end surface of the terminal connection part 11. Thereby it is possible to securely prevent the removal of the electric wire provided with the terminal fitting from the cavity 41. That is, the terminal fitting 10 can be utilized for electric wires in which the thicknesses of the core wires 31 are different from one another.

Embodiment 2

Figure 5:
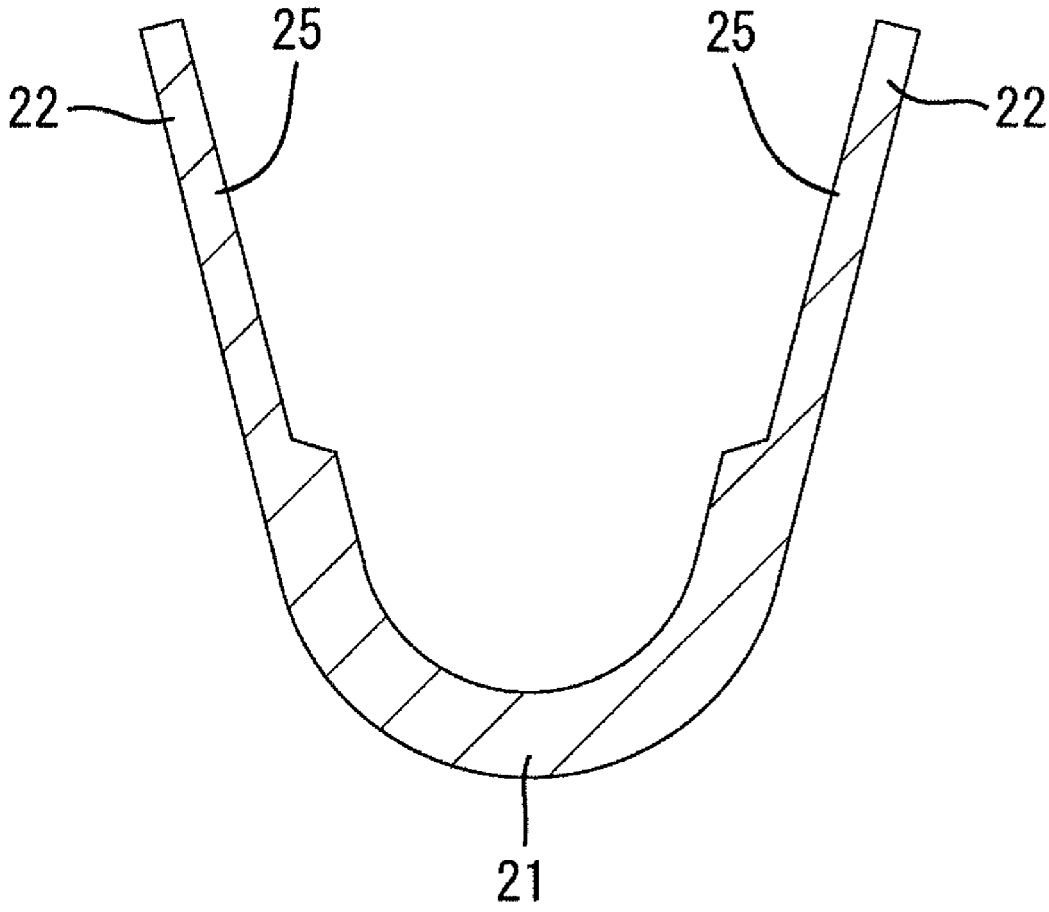
FIG. 5 is a sectional view showing the configuration of a wire barrel portion of an embodiment 2 before the wire barrel portion is crimped to an electric wire.

The embodiment 2 of the present invention is described below with reference to FIG. 5. A thin portion 25 of an electric wire provided with a terminal fitting of the embodiment 2 has a construction different from that of the embodiment 1. Other constructions of the electric wire provided with the terminal fitting of the embodiment 2 are the same as those of the electric wire provided with the terminal fitting of the embodiment 1. Therefore the same constructions of the electric wire provided with the terminal fitting of the embodiment 2 as those of the electric wire provided with the terminal fitting of the embodiment 1 are denoted by the same reference numerals as those of the embodiment 1 and the description of the construction, operation, and effect thereof are omitted herein.

In the electric wire provided with the terminal fitting of the embodiment 2, the thin portion 25 is formed by extending it to a front edge of each crimping piece 22. In this case, the crimping piece 22 is thinned in the range from its intermediate portion to its front edge by striking. Thus the thin portion 25 can be easily formed. Because the front edge of the crimping piece 22 is thin, the front edge thereof is easily capable of penetrating into gaps between the adjacent core wires 31 when the thin portion 25 is crimped. Therefore it is possible to easily crimp the wire barrel portion 13 and make the vertical dimension thereof small and thus make the height thereof low.

Embodiment 3

Figure 6:
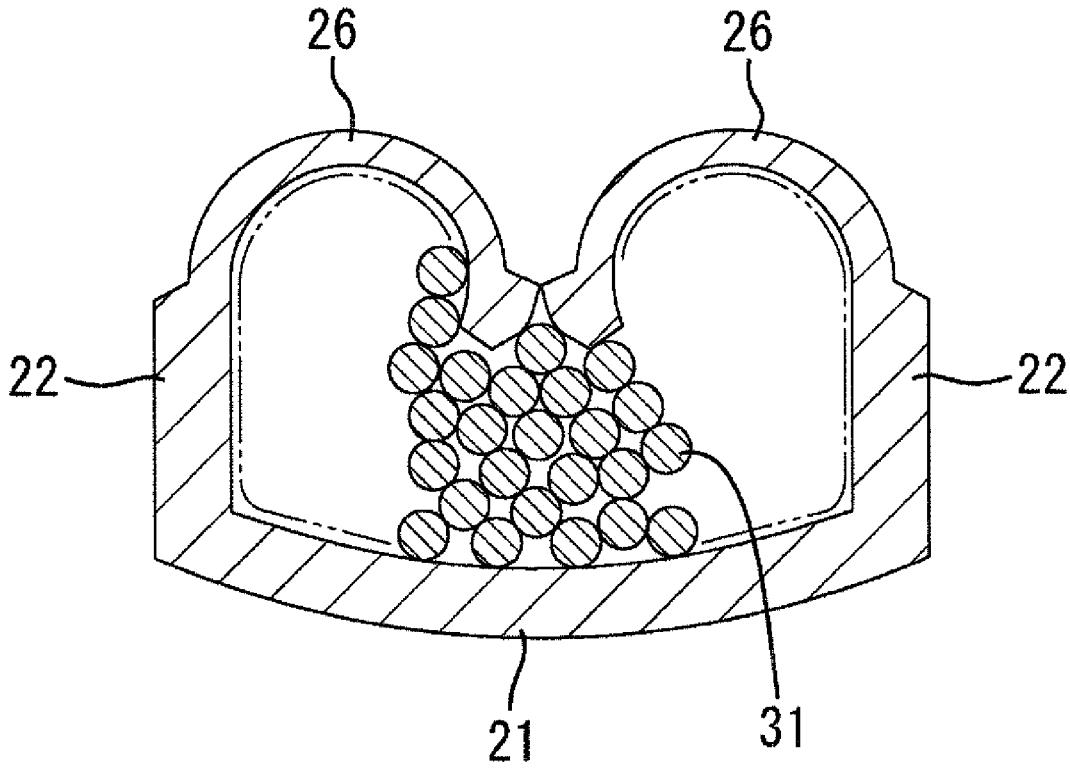
FIG. 6 is a sectional view showing the configuration of a wire barrel portion of an embodiment 3 after the wire barrel portion is crimped to the electric wire.
Figure 7:
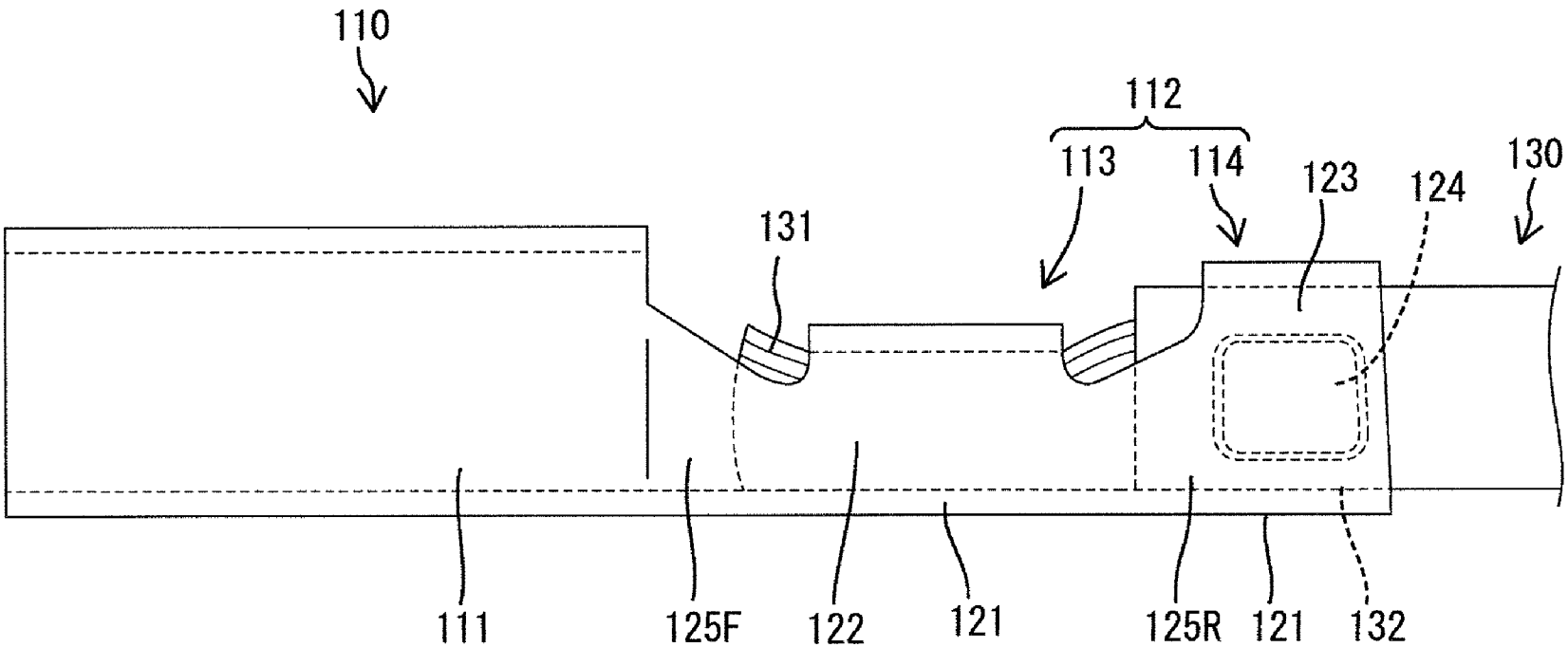
FIG. 7 is a schematic side view of an electric wire provided with a terminal fitting of an embodiment 4.

The embodiment 3 of the present invention is described below with reference to FIG. 6. A thin portion 26 of an electric wire provided with a terminal fitting of the embodiment 3 has a construction different from that of the embodiment 1. Other constructions of the electric wire provided with the terminal fitting of the embodiment 3 are the same as those of the electric wire provided with the terminal fitting of the embodiment 1. Therefore the same constructions of the electric wire provided with the terminal fitting of the embodiment 3 as those of the electric wire provided with the terminal fitting of the embodiment 1 are denoted by the same reference numerals as those of the embodiment 1 and the description of the construction, operation, and effect thereof are omitted herein.

In the electric wire provided with the terminal fitting of the embodiment 3, the thin portion 26 is formed by recessing the outer surface of the crimping piece 22 which faces upward when the crimping piece 22 is crimped, namely, by recessing the surface of the crimping piece 22 opposite to the surface thereof opposed to the core wires 31. In this case, it is also possible to make the vertical dimension of the wire barrel portion 13 small and thus make the height thereof low.

The following forms of the embodiments 1 through 3 are included in the technical scope of the present invention.

(1) In the embodiments 1 through 3, only one of the inner and outer surfaces of the crimping piece is recessed to form the thin portion, but both inner and outer surfaces thereof may be recessed to form the thin portion.

(2) In the embodiments 1 through 3, the thin portion is formed at only the portion, of the crimping piece, which contacts the core wires from above when the crimping piece is crimped. But the thin portion may be formed on the crimping piece by extending the thin portion to a portion, of the crimping piece, which contacts the sides of the core wires. In addition the thin portion may be formed at only the portion, of the crimping piece, which contacts the sides of the core wires.

(3) In the embodiments 1 through 3, the female terminal fitting having the prism-shaped terminal connection part has been described. The present invention is also applicable to a male terminal fitting having a male tab composed of a long and narrow terminal connection part.

Embodiment 4

The embodiment 4 of the present invention is described below with reference to FIGS. 7 through 10. An electric wire provided with a terminal fitting of the embodiment 4 has an electric wire 130 and a terminal fitting 110 to be crimped to an end portion of the electric wire 130. The terminal fitting 110 is of a female type. At a front part of the terminal fitting 110, there is formed a prism-shaped terminal connection part 111 into which a long and narrow male tab formed on a mating terminal fitting of a male type is inserted to connect the male tab thereto. The electric wire 130 is composed of coating and core wires 131 surrounded with the coating. As the material of the core wire 131, aluminum or an aluminum alloy is used. Because aluminum has a lower conductivity than copper, the diameter of the core wire 131 is set larger than that of a core wire made of copper to secure a predetermined current value.

A crimping part 112 to be crimped to the electric wire 130 is formed at a rear part of the terminal fitting 110. The crimping part 12 is constructed of a wire barrel portion 113 and an insulation barrel portion 114 disposed rearward from the wire barrel portion 113. The wire barrel portion 113 is constructed of a lower plate part 121 continuous with the terminal connection part 111 and a pair of crimping pieces 122 raised at left and right side edges of the lower plate part 121. The lower plate part 121 and the crimping piece 122 are formed symmetrically in the left-to-right direction of the terminal fitting 110. The insulation barrel portion 114 is constructed of a part of the lower plate part 121 disposed rearward from the wire barrel portion 113 and a pair of crimping pieces 123 raised at the left and right side edges of the lower plate part 121. The lower plate part 121 and the crimping piece 123 are also formed symmetrically in the left-to-right direction of the terminal fitting 110. A lower portion of a front end of the crimping piece 122 of the wire barrel portion 113 is continuous with a rear end of a side wall of the terminal connection part 111 through a first connection portion 125F. A lower portion of a rear end of the crimping piece 122 of the wire barrel portion 113 is continuous with a lower portion of a front end of the crimping piece 123 of the insulation barrel portion 114 through a second connection portion 125R.

Figure 8:
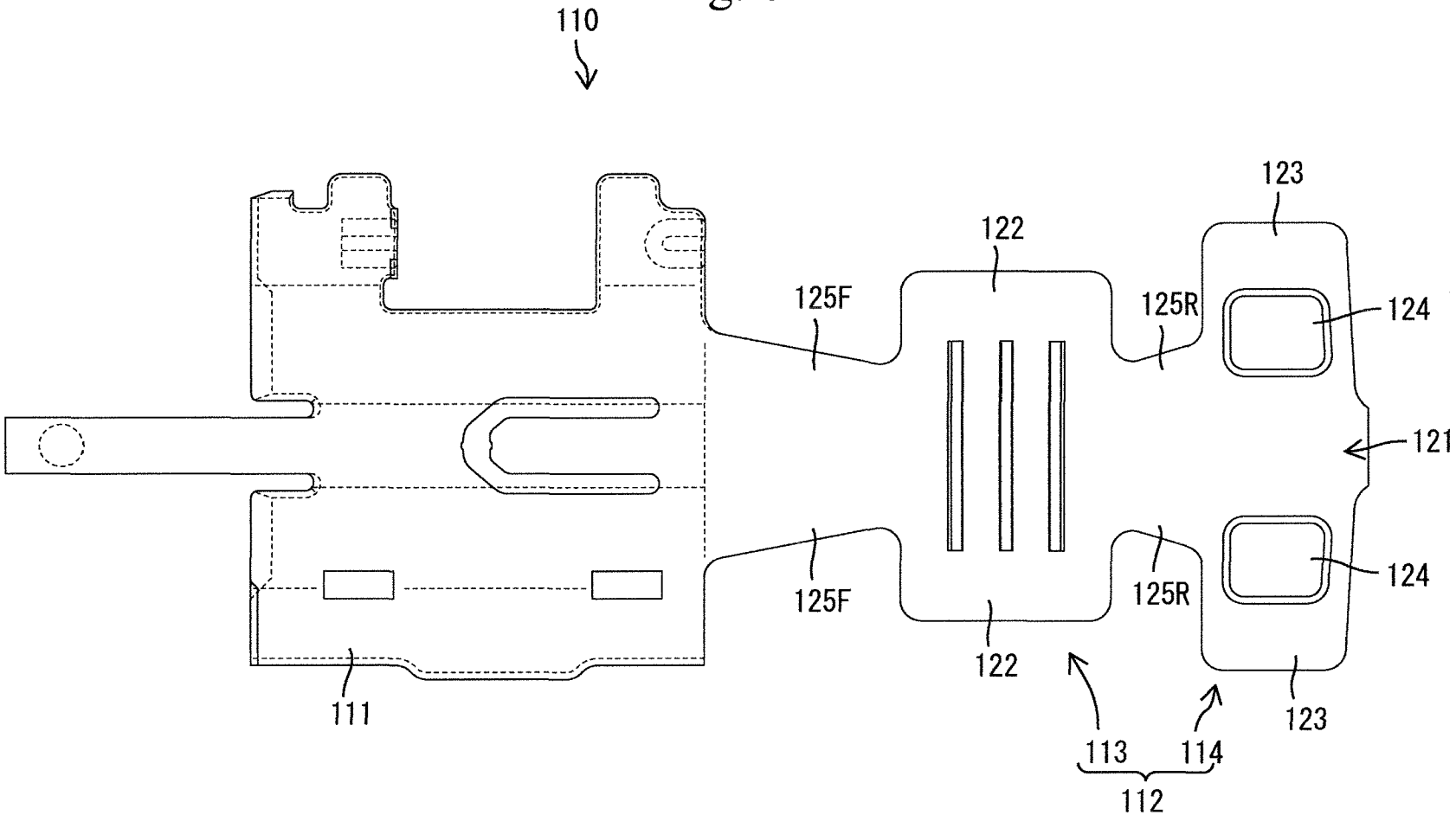
FIG. 8 is a plan view showing a metal plate material from which the terminal fitting of the embodiment 4 is formed.

The entire lower plate part 121 of the insulation barrel portion 114 is formed in an almost constant thickness. Each of the crimping pieces 123 of the insulation barrel portion 114 is formed thinner than the lower plate part 121 and has a thin portion 124 which contacts a portion 132 having the coating disposed at the end portion of the electric wire 130 in a lateral direction when the crimping piece 123 is crimped. The thin portion 124 is formed by recessing a portion of an inner surface of the crimping piece 123 opposed to the portion 132 having the coating disposed at the end portion of the electric wire 130 when the crimping piece 123 is crimped. As shown in FIG. 8, the thin portion 124 is formed by punching a metal plate material having a constant thickness into a predetermined configuration and striking each crimping piece 123 so as to form the thin portion 124 as an almost rectangular configuration at an intermediate portion of each crimping piece 123. That is, the thin portion 124 is constructed as a concave portion for each crimping piece 123 by disposing the thin portion 124 at an intermediate portion of each of the crimping pieces 123 except for a peripheral portion thereof. In this case, the thin portion 124 is formed in only the crimping piece 123 of the insulation barrel portion 114. For example, the thin portion 124 is not formed at the lower plate part 121. Thus it is possible to restrain the whole length of the terminal fitting 110 from greatly elongating, although the metal plate material is stricken. There is a fear that the metal plate material of the thin portion 124 elongates to some extent owing to the striking. But in the embodiment 4, the intermediate portion of each crimping piece 123 is stricken. Therefore only the crimping piece 123 longitudinally elongates to a slight extent.

Figure 9:
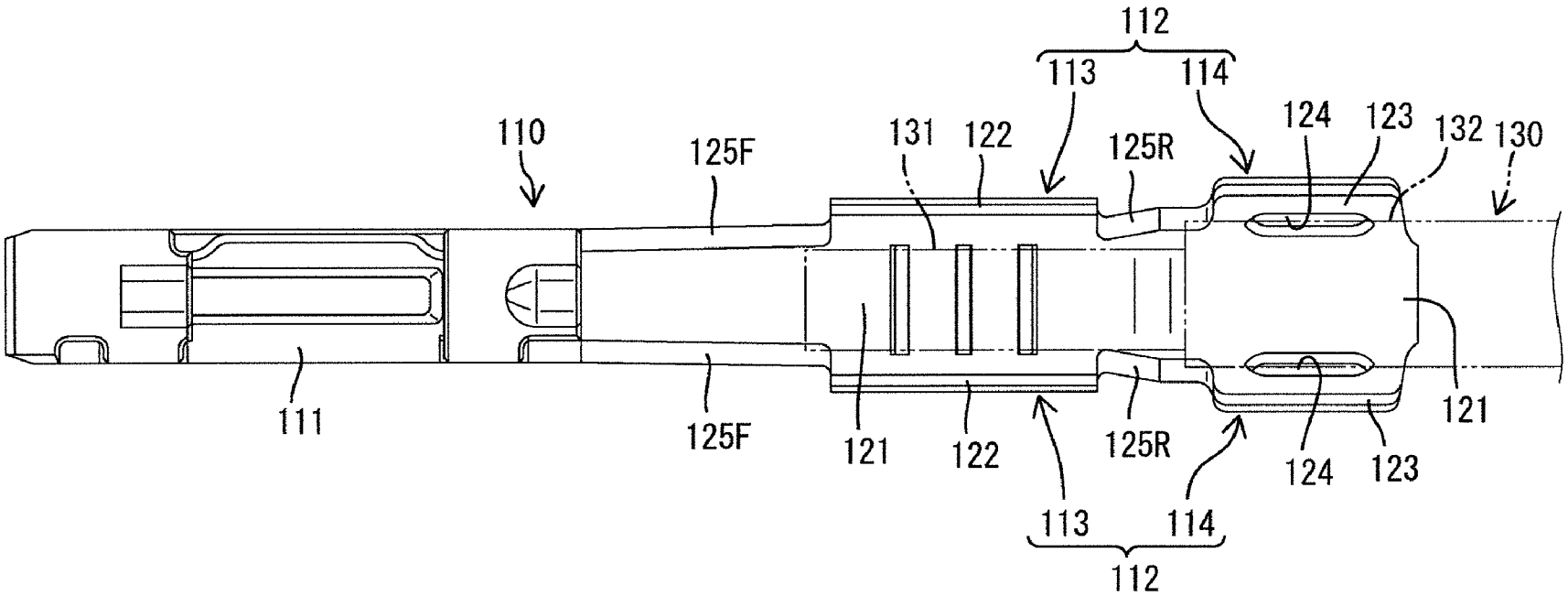
FIG. 9 is a plan view showing a state before a crimping part of the embodiment 4 is crimped to the electric wire.
Figure 10:
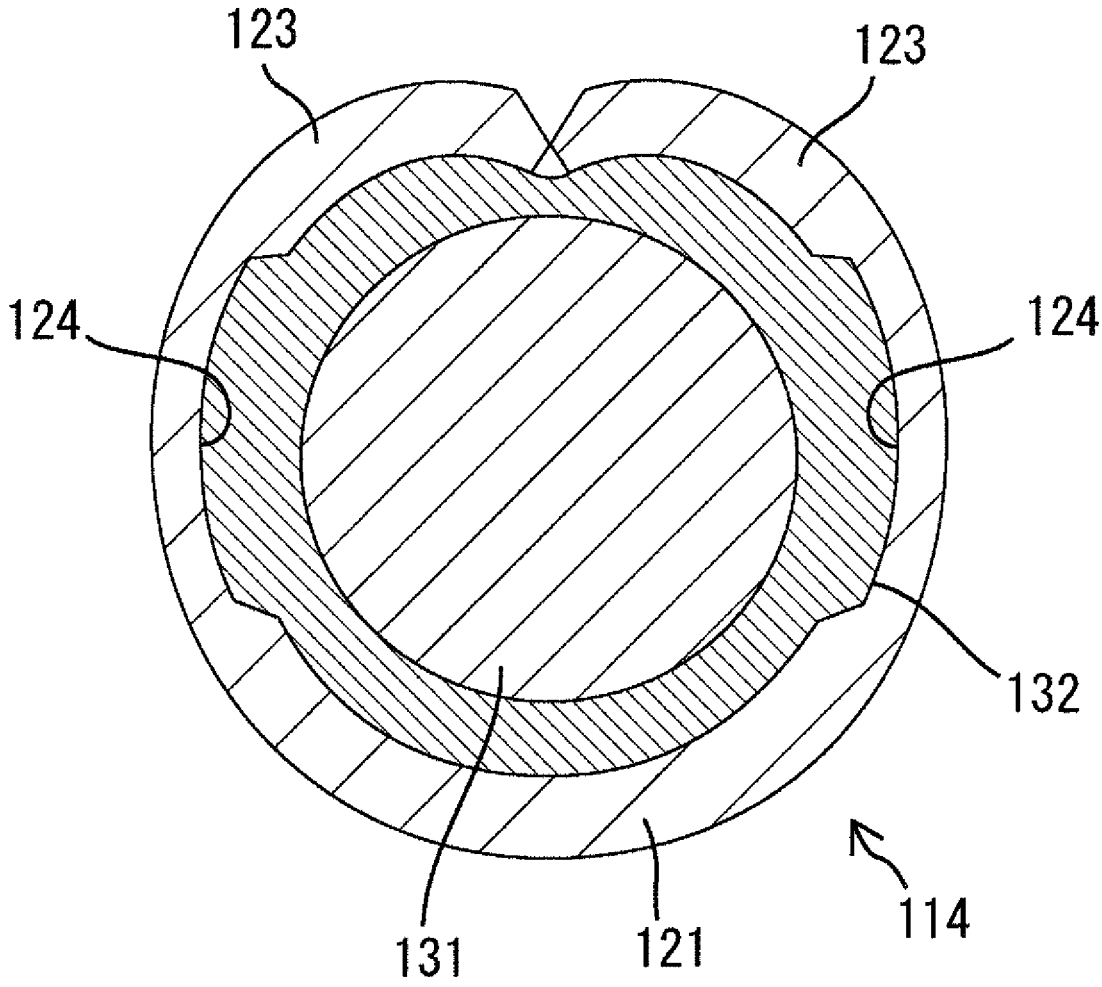
FIG. 10 is a sectional view showing an insulation barrel portion of the embodiment 4 crimped to the electric wire.

As shown in FIG. 9, the electric wire 130 is placed at the lower plate part 121 of the terminal fitting 110 having the above-described construction such that the core wires 131 are positioned at the wire barrel portion 113 and that the portion 132 having the coating disposed at the end portion of the electric wire 130 is positioned at the insulation barrel portion 114. In this state, the crimping piece 122 of the wire barrel portion 113 and the crimping piece 123 of the insulation barrel portion 114 are pressed from above. As shown in FIG. 10, at the insulation barrel portion 114, the crimping piece 123 is crimped in such a way that the thin portion 124 contacts the portion 132 having the coating disposed at the end portion of the electric wire 130 in a lateral direction with the portion 132 having the coating disposed at the end portion of the electric wire 130 being surrounded with the lower plate part 121 and the crimping piece 123. Therefore it is possible to decrease the dimension of the insulation barrel portion 114 in the left-to-right direction thereof and thereby make the terminal fitting 110 compact. At the barrel portion 113, the crimping piece 122 is crimped with the lower plate part 121 and the crimping piece 122 surrounding the core wires 131 exposed outside as a result of the removal of the coating disposed at the end portion of the electric wire 130. In this manner, the terminal fitting 110 is crimped to the end portion of the electric wire 130.

It is possible to decrease the dimension of the insulation barrel portion 114 of the electric wire provided with the terminal fitting having the above-described construction in the left-to-right direction thereof. Therefore in mounting the terminal fitting 110 on an electric wire having the thick core wires 131, the dimension of the insulation barrel portion 114 in the left-to-right direction thereof does not become large. Thus the terminal fitting 110 can be inserted into cavities formed inside the connector housing without making them large. That is, the terminal fitting 110 can be utilized for electric wires having different thicknesses. Further by making the terminal fitting 110 compact, it is possible to decrease the interval between the cavities formed inside the connector housing.

Embodiment 5

Figure 11:
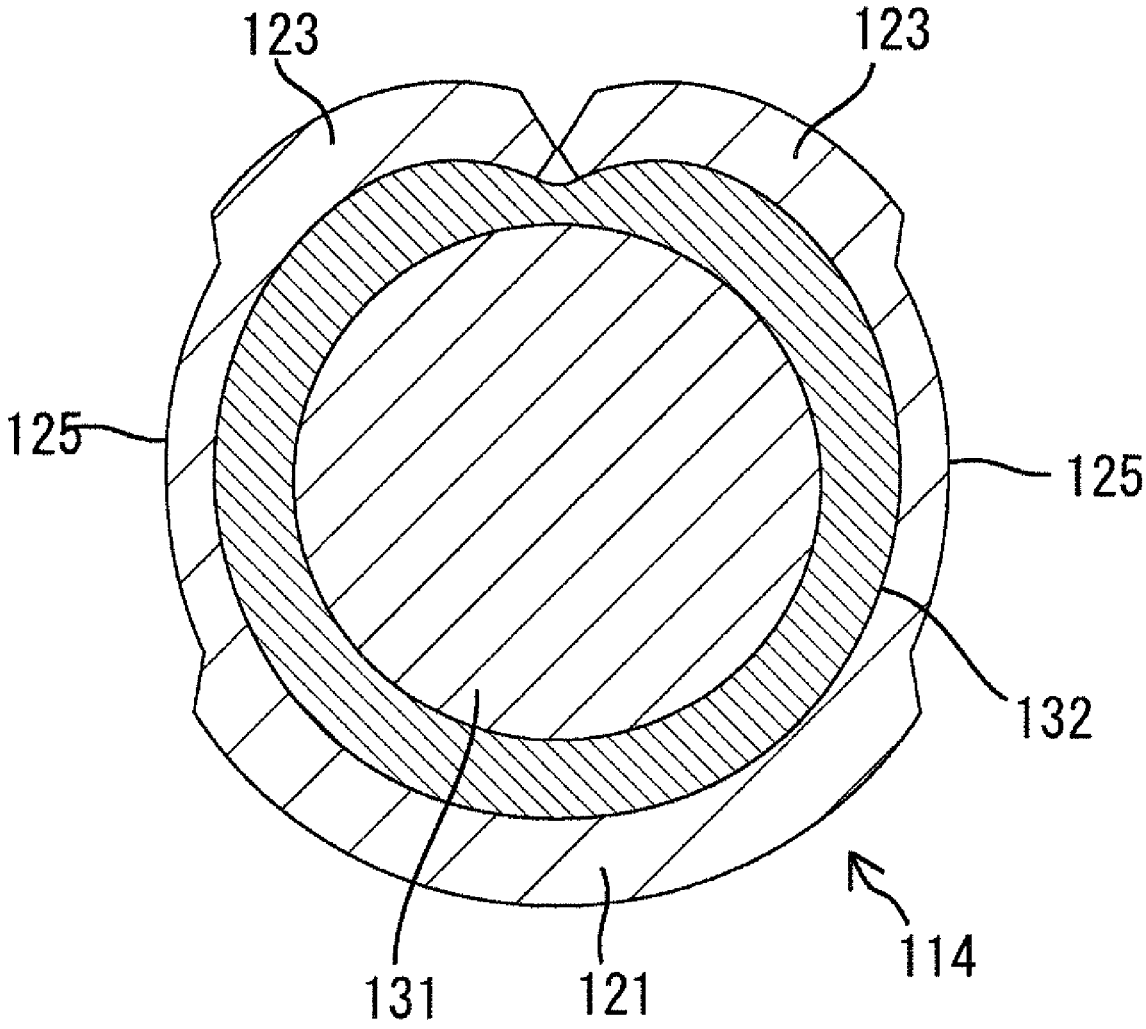
FIG. 11 is a sectional view showing an insulation barrel portion of an embodiment 5 crimped to an electric wire.

The embodiment 5 of the present invention is described below with reference to FIG. 11. A thin portion 125 of an electric wire provided with a terminal fitting of the embodiment 5 has a construction different from that of the embodiment 4. Other constructions of the electric wire provided with the terminal fitting of the embodiment 5 are the same as those of the electric wire provided with the terminal fitting of the embodiment 4. Therefore the same constructions of the electric wire provided with the terminal fitting of the embodiment 5 as those of the electric wire provided with the terminal fitting of the embodiment 4 are denoted by the same reference numerals as those of the embodiment 4 and the description of the construction, operation, and effect thereof are omitted herein.

In the electric wire provided with the terminal fitting of the embodiment 5, the thin portion 125 is formed by recessing the outer surface of the crimping piece which faces outward in a lateral direction when the crimping piece is crimped, namely, by recessing the surface of the crimping piece opposite to the surface thereof opposed to the portion 132 having the coating disposed at the end portion of the electric wire 130. In this case, it is possible to decrease the dimension of the insulation barrel portion 114 in the lateral direction thereof and thus make the terminal fitting 110 compact.

The following forms of the embodiments 4 and 5 are included in the technical scope of the present invention.

(1) In the embodiments 4 and 5, the thin portion is formed at the intermediate portion of the crimping piece, but may be formed by extending it to the front edge of the crimping piece.

(2) In the embodiments 4 and 5, only one of the inner and outer surfaces of the crimping piece is recessed to form the thin portion, but both inner and outer surfaces thereof may be recessed to form the thin portion.

(3) In the embodiments 4 and 5, the female terminal fitting having the prism-shaped terminal connection part has been described. The present invention is also applicable to a male terminal fitting having a male tab composed of a long and narrow terminal connection part.

The invention claimed is:

1. A terminal fitting comprising:

a terminal connection part formed at a front part thereof and connected to a mating terminal; and a crimping part formed at a rear part of said terminal fitting and composed of a lower plate part continuous with said terminal connection part and front and rear pairs of crimping pieces disposed respectively at front and rear positions of said crimping part, the crimping pieces in each of the pairs of crimping pieces being raised respectively from left and right side edges of said lower plate part, wherein said pair of front crimping pieces and said lower plate part constitute a wire barrel portion that contacts core wires exposed outside as a result of removal of coating disposed at an end portion of an electric wire and is crimped so as to surround said core wires;

said pair of rear crimping pieces and said lower plate part constitute an insulation barrel portion that contacts coating at said end portion of the electric wire and is crimped so as to surround said coating;

at least one pair of said crimping pieces has a thin portion formed thinner than said lower plate part and contacting said end portion of said electric wire when said crimping pieces are crimped; and said thin portion is formed at an intermediate portion of each of said crimping pieces except for a peripheral portion thereof.

2. A terminal fitting according to claim 1, wherein said thin portion is formed in the crimping piece of the wire barrel portion and contacts said core wires from above when said crimping pieces are crimped.

3. A terminal fitting according to claim 1, wherein said thin portion is formed by recessing an inner surface, of each of said crimping pieces, which is opposed to said end portion of said electric wire when said crimping pieces are crimped.

4. A terminal fitting according to claim 2, wherein said thin portion is formed by recessing an outer surface, of each of said crimping pieces, which faces upward when said crimping pieces are crimped.

5. A terminal fitting according to claim 1, wherein said thin portion is formed on only said crimping pieces of said wire barrel portion.

6. A terminal fitting according to claim 1, wherein said thin portion is formed on said crimping pieces of said insulation barrel portion.

7. A terminal fitting according to claim 6, wherein said thin portion contacts said coating at said end portion of said electric wire in a lateral direction when said crimping pieces are crimped.

8. A terminal fitting according to claim 6, wherein said thin portion is formed by recessing an inner surface, of each of said crimping pieces, which is opposed to said coating at said end portion of said electric wire when said crimping pieces are crimped.

9. A terminal fitting according to claim 7, wherein said thin portion is formed by recessing an outer surface, of each of said crimping pieces, which faces outward in a lateral direction when said crimping pieces are crimped.

10. A terminal fitting according to claim 6, wherein said thin portion is formed on only said crimping pieces of said insulation barrel portion.

11. A terminal fitting according to claim 1, wherein said thin portion is formed at an intermediate portion of each of said crimping pieces by striking.

12. An electric wire provided with a terminal fitting, according to claim 1, which is connected to an end portion thereof.

* * * * *